United States Patent [19]

Kirtley, Jr.

[11] Patent Number: 4,531,858

[45] Date of Patent: Jul. 30, 1985

[54] PARTIALLY SEPARABLE ATTACHMENT DEVICE FOR SHEET METAL SCREED AND STAKE ASSEMBLIES

[76] Inventor: Robert H. Kirtley, Jr., 3033 - 35th Ave., N., Birmingham, Ala. 35027

[21] Appl. No.: 542,176

[22] Filed: Oct. 14, 1983

[51] Int. Cl.[3] ..... E01C 11/02

[52] U.S. Cl. ..... 404/48; 52/99; 52/396; 404/50; 404/68

[58] Field of Search ..... 52/98, 99, 100, 364, 52/367, 371, 393, 395, 396, 402, 403, 127.2; 404/47-51, 67-69

[56] References Cited

U.S. PATENT DOCUMENTS

| | | | |
|---|---|---|---|
| 1,460,841 | 7/1923 | Briody | 404/68 X |
| 1,629,750 | 5/1927 | Weller | 404/51 |
| 1,806,275 | 5/1931 | Adler | 404/50 |
| 2,016,858 | 10/1935 | Hall | 404/68 |
| 2,535,135 | 12/1950 | Jacobson | 404/50 |
| 2,798,418 | 7/1957 | Dunnam | 52/396 X |
| 3,953,661 | 4/1976 | Gulley | 52/99 |
| 4,012,159 | 3/1977 | Berry | 404/48 X |

FOREIGN PATENT DOCUMENTS

| | | | |
|---|---|---|---|
| 656210 | 1/1963 | Canada | 404/68 |

*Primary Examiner*—J. Karl Bell
*Assistant Examiner*—Richard E. Chilcot, Jr.
*Attorney, Agent, or Firm*—Ernest H. Schmidt

[57] ABSTRACT

A partially separable attachment device for sheet metal screed and stake assemblies of the type used in forming concrete ground slabs serves to hold top portions of the sheet metal screed and its supporting screed stakes in interassembled relation for use in the screed-forming of concrete slabs of large area in smaller slab sections. The attachment device has a head portion projecting upwardly of the assemblage which serves as the screeding upper edge. This head portion is torn away after setting of the adjacent slab sections to provide recesses for the placement of caulking material protecting against the entrance of moisture.

7 Claims, 3 Drawing Figures

PARTIALLY SEPARABLE ATTACHMENT DEVICE FOR SHEET METAL SCREED AND STAKE ASSEMBLIES

BACKGROUND OF THE INVENTION

In the forming of large-area, flat concrete ground slabs in building construction, it is common practice to place the pour in sections with the use of peripheral sheet metal screeds at the junctures between sections. Among the advantages of this procedure are that the heavy work of placement can proceed at a more leisurely pace, the screeding of relatively small areas produces a flatter slab, and the finished slab sections have a slight "float" with respect to one another at their screed junctures, thereby relieving stresses such as caused by temperature changes which might otherwise occur in a comparatively large monolithic slab pour. The sheet metal screeds used are assemblies of a screed member having a reversely-bent marginal upper end portion providing a longitudinally-extending recess open at the bottom, which is hookingly engaged over the upper end of a plurality of sheet metal stakes spaced therealong and which are set into the foundation ground at appropriate distances to maintain the upper end of the screed at the upper level of the slab to be poured.

One of the deficiencies of using sheet metal screed and stake assemblies as described above for forming large area slab sections, is that the slab section junctures along the embedded screeds are difficult to seal against water infiltration. Caulking, if applied along the line of juncture, necessarily projects above the surface of the slab, and is therefore readily destroyed if the slab is used without floor covering, such as in warehouses, for example.

SUMMARY OF THE INVENTION

It is, accordingly, the principal object of this invention to provide a partially separable attachment device for sheet metal screed and stake assemblies of the character above described wherein, after the poured slab section has set, an exposed portion at the upper end of each screed attachment device can readily be torn away and discarded to provide longitudinally-extending recesses along each screed juncture which can be filled with a suitable caulking material, flush with the top of the slab, providing lasting protection against the entrance of moisture at the screeded junctures.

A more particular object of this invention is to provide a partially separable attachment device for sheet metal screed and stake assemblies, having a body portion which serves to secure together the upper end portions of the mutually assembled stake and screed assemblies, and a head portion projecting upwardly of the assemblage to serve as the upper screed edge during slab section formation, and which can subsequently be removed by tearing away to provide the caulking recess. To this end, the separable attachment device is integrally extruded of synthetic plastic materials, the head portion being of relatively soft material as compared with the body portion so as to be capable of being readily torn away, beginning at one end, after a poured slab section has set.

Another object of the invention is to provide the partially separable attachment device for sheet metal screed and stake assemblies, which will be simple in construction and inexpensive to manufacture, and which will be easy to use in the assembly of sheet metal screeds to their supporting stakes.

Other objects, features and advantages of the invention will be apparent from the following description when read with reference to the accompanying drawings.

BRIEF DESCRIPTION OF THE DRAWINGS

In the drawings, wherein like reference numerals denote corresponding parts throughout the several views.

DESCRIPTION OF THE PREFERRED EMBODIMENT

Figure 1:
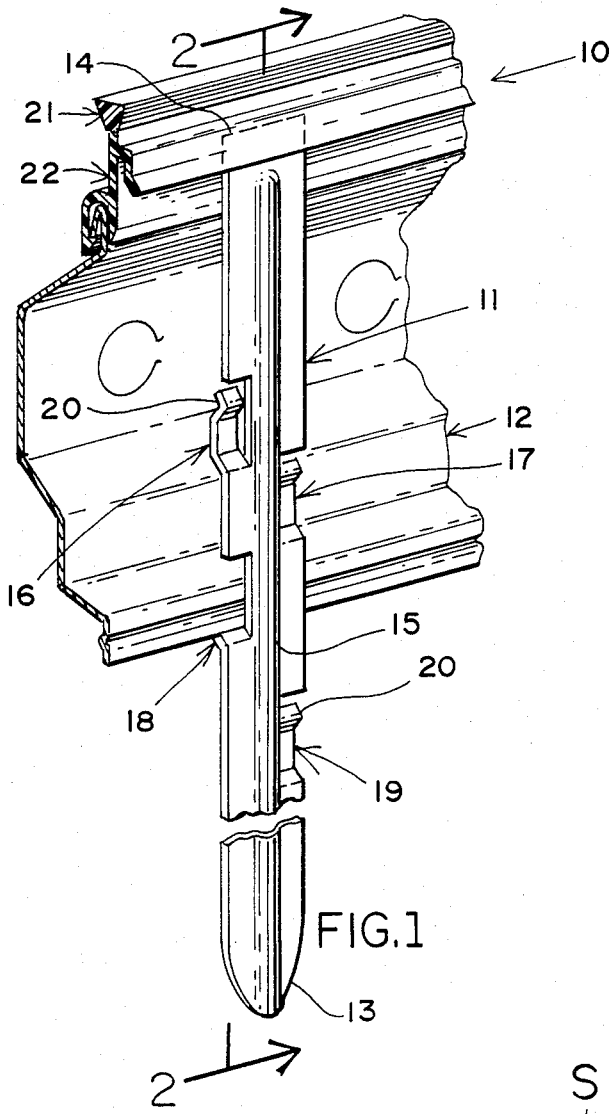
FIG. 1 is an oblique view of a sheet metal screed and stake assembly equipped with a partially separable attachment device embodying the invention.

Referring now in detail to the drawings, reference numeral 10 designates, generally, a partially separable attachment device embodying the invention, illustrating its use in combination with a stamped metal screed stake 11 and stamped sheet metal screed 12. As is hereinbelow more particularly described, the partially separable attachment device 10 serves in part to hold the screed stake 11 and screed 12 in interassembled relation for use in the screed forming of concrete slabs of large area into slab sections.

Each screed stake 11 is fabricated of sheet steel, and is of elongated shape having a blunt point 13 at one end for driving into the ground, and a square-cut edge 14 at the other end. For increased rigidity, the metal stake is stamped with a central, protruding rib 15 along its length, which will preferably be arcuate in cross-sectional shape. The rib 15 extends somewhat short of the upper end of the stake, leaving a short, flat zone for interfitting with respect to the partially separable attachment device 10, as is hereinbelow more particularly described.

The lateral, flat, side portions of each stake are stamped along their lengths and at each side with a plurality of alternately spaced tongue portions 16, 17, 18 and 19, the upper free ends of which are each provided with reversely-bent, inwardly-directed projections 20. The stamped-out tongue portions 16, 17, 18 and 19 define notches adapted to interhookingly engage lower edge portions of metal screeds 12 of different height, selectively. In use, as best illustrated in FIG. 1, the lower marginal edge portion of a sheet metal screed 12 of a given height or depth to be supported, will be fitted down into the corresponding notch defined by tongue portions 16, 17, 18 or 19, for example. The partially separable attachment device 10 embodying the invention is used to secure together the upper ends of the mutually assembled stake 11 and screed 12 in a manner hereinbelow described.

Figure 2:
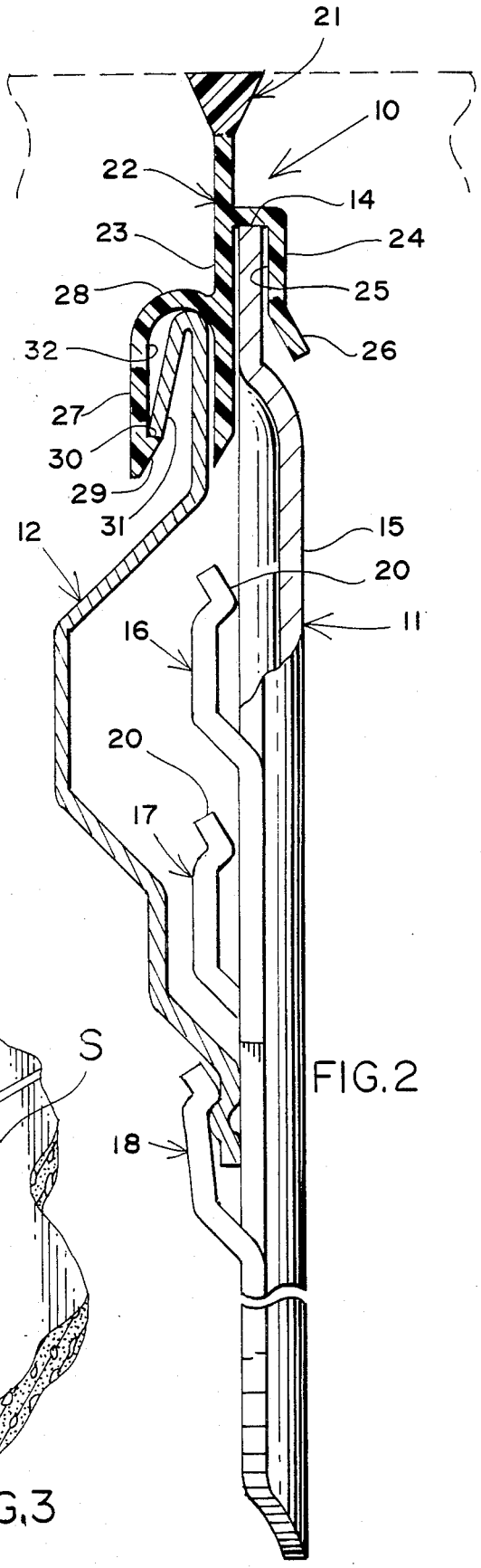
FIG. 2 is a partial vertical cross-sectional view taken along the plane indicated at 2—2 of FIG. 1 in the direction of the arrows and on an enlarged scale.

As best illustrated in FIGS. 1 and 2, the partially separable attachment device 10 is integrally formed, such as by extrusion, of a synthetic plastic material such as polyvinyl chloride, preferably in the same lengths as the lengths of the screeds to which they are applied. In accordance with the invention, the top or head portion 21 of the partially separable attachment device 10 is of relatively soft PVC as compared with the body portion 22, so as to be capable of being torn away, beginning at one end, after a poured slab has hardened or set, in the manner and for the purpose hereinafter more particularly described.

The body portion 22 of the elongated partially separable attachment device 10 comprises a vertical wall portion 23, integrally formed at one side with a laterally-offset wall portion 24 defining an inverted channel 25 for the interfitting reception of the upper end portion 14 of a screed stake. As illustrated at 26, the outer end of the offset wall portion 24 is outwardly-bent at an acute angle to serve as a guide surface for the reception of the stake end. The opposite side of the vertical wall portion 23 is integrally-formed, in downwardly spaced relation with respect to the laterally-offset wall portion 24, with a second laterally-offset wall portion 27 which joins said vertical wall portion through an arcuate top wall portion 28. The lower end of the second laterally-offset wall portion 27 is formed with an inwardly-directed tapered end portion 29 defining a longitudinally-extending, upwardly-facing shoulder 30.

Referring to FIG. 2 it will be seen that, for a given screed 12 fitted at its lower end in a stake tongue slot 18 for example, corresponding to the height of the screed, the stake also interconnects with the partially separable attachment device 10 when said attachment device is fitted to the upper end of the screed stake. To this end, a reversely-bent marginal edge portion 31 along the upper end of the screed 12 fits within the channel 32 defined by the second laterally-offset wall portion 27. In so fitting, as best illustrated in FIG. 2, the resiliancy of the laterally-offset wall 27 permits the lower, outer edge of the screed marginal edge portion 31 to slide past the tapered edge portion 29. The outer longitudinal edge of the marginal edge portion 31 will thus be brought into engagement with and captured by the shoulder 30 to prevent withdrawal of the partially separable attachment device 10, not only before, but particularly after the concrete slab has been poured.

Figure 3:
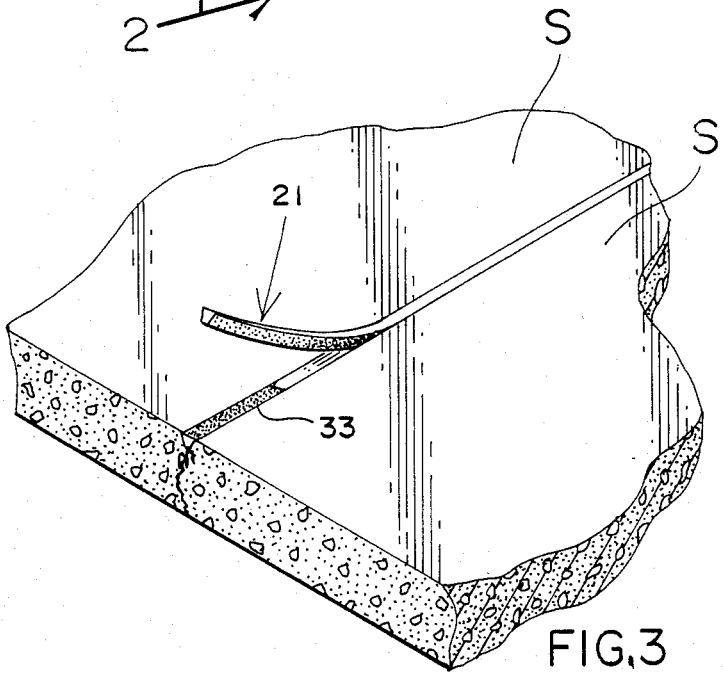
FIG. 3 is an oblique view, as seen from above, of a rectangular concrete slab, illustrating use of the screed assembly and attachment device in dividing the slab into sections.

In use, after a screeded concrete slab S has set, one end of the exposed head portion 21 of the partially separable attachment device 10 will be separated from its body portion 22 and torn away, as illustrated by way of example in FIG. 3. After its removal, a suitable caulking material 33 will be used to fill the void thereby created to seal against the entrance of moisture while at the same time providing for expansion and contraction of the adjacent slab portions or sections.

While I have illustrated and described herein only one form in which my invention can conveniently be embodied in practice, it is to be understood that this embodiment is presented by way of example only and not in a limiting sense. The invention, in brief, comprises all the embodiments and modifications coming within the scope and spirit of the following claims.

What I claim as new and desire to secure by Letters Patent is:

1. A partially separable attachment device for use with sheet metal screed and stake assemblies of the type wherein the screed has a reversely-bent marginal upper end portion providing a longitudinally-extending-recess, open at the bottom, and an elongated sheet metal stake member having a blunt point at the lower end and a square cut edge at the upper end, comprising, in combination, an elongated member of uniform cross-sectional shape having, along its length, a head portion integrally formed with a depending body portion, said body portion comprising a vertical wall portion integrally formed at one side with a first laterally-offset wall portion defining an inverted, longitudinally-extending recess, open at the bottom, for the interfitting reception of the upper end portion of the screed stake, an other side of said vertical wall portion being integrally formed with a second laterally-offset wall portion defining a second longitudinally-extending recess, open at the bottom, for the interfitting reception of the reversely-bent marginal upper end portion of the screed, means for interhookingly securing said reversely-bent marginal upper end portion of the screed within said second longitudinally-extending recess, said elongated member being fabricated of a flexible, synthetic plastic material, and means enabling the manual stripping away of said head portion of said elongated member from said body portion thereof 2. A partially separable attachment device as defined in claim 1, wherein said elongated member is fabricated by extrusion of the synthetic plastic material, said means enabling the manual stripping away of said head portion thereof comprising said head portion being formed of a relatively soft synthetic plastic material as compared with the synthetic plastic material forming said body portion.

3. A partially separable attachment device as defined in claim 2, wherein said elongated member is fabricated of polyvinyl chloride.

4. A partially separable attachment device as defined in claim 1 wherein said means for interhookingly securing said reversely-bent marginal end portion within second longitudinally-extending recess comprises an inwardly-directed, upwardly-facing, longitudinally-extending shoulder formed at the lower end of said second laterally-offset wall portion.

5. A partially separable attachment device as defined in claim 4 wherein said lower end of said second laterally-offset wall portion further comprises an inwardly-directed, tapered end portion defining said longitudinally-extending shoulder.

6. A partially separable attachment device as defined in claim 1 wherein the outer end of said first laterally-offset wall portion terminates in an outwardly-bent portion serving as a guide surface for the reception of the upper end of the screed stake into the associated recess.

7. A partially separable attachment device as defined in claim 1, wherein said head portion of said elongated member is of frusto-conical cross-sectional shape, the side walls thereof diverging in mutually opposed directions as they extend upwardly from their juncture with the upper end of said body portion.

* * * * *